US011274415B2

(12) United States Patent
Murakami et al.

(10) Patent No.: US 11,274,415 B2
(45) Date of Patent: Mar. 15, 2022

(54) BUCKET AND WORK VEHICLE

(71) Applicant: KOMATSU LTD., Tokyo (JP)

(72) Inventors: Junichi Murakami, Tokyo (JP); Naohisa Iwasawa, Tokyo (JP); Yukihide Yoshihara, Tokyo (JP); Akinobu Iwasaki, Tokyo (JP); Yuki Monnai, Tokyo (JP); Nobuyasu Sugihara, Tokyo (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 17/259,587

(22) PCT Filed: Sep. 9, 2019

(86) PCT No.: PCT/JP2019/035293
§ 371 (c)(1),
(2) Date: Jan. 12, 2021

(87) PCT Pub. No.: WO2020/054639
PCT Pub. Date: Mar. 19, 2020

(65) Prior Publication Data

US 2021/0317630 A1 Oct. 14, 2021

(30) Foreign Application Priority Data

Sep. 10, 2018 (JP) ..... JP2018-168691

(51) Int. Cl.
*E02F 3/40* (2006.01)
*E02F 3/32* (2006.01)

(52) U.S. Cl.
CPC . *E02F 3/40* (2013.01); *E02F 3/32* (2013.01)

(58) Field of Classification Search
None
See application file for complete search history.

(56) References Cited

U.S. PATENT DOCUMENTS 9,957,689 B2 * 5/2018 Rochel ..... E02F 3/40
2005/0268500 A1 12/2005 Imamura et al.
(Continued)

FOREIGN PATENT DOCUMENTS

CN 103857843 A 6/2014
CN 103993617 A 8/2014
(Continued)

OTHER PUBLICATIONS

Zheng Chunqu et al., "Construction Machinery and Equipment" 11th edition, Nov. 30, 1999, Soil Cutting Test, pp. 10-12 (with attached English-language translation).

*Primary Examiner* — Gerald McClain
(74) *Attorney, Agent, or Firm* — Faegre Drinker Biddle & Reath LLP

(57) ABSTRACT

A bottom plate includes a first deepest portion at which a length from a first reference straight line to the bottom plate is maximum. The first reference straight line passes through a front end portion of a front lip and a position at which a rear end portion of the bottom plate is contiguous to each of side plates. The first deepest portion is located on a second reference straight line orthogonal to the first reference straight line. A side end portion of each of the side plates is provided with a recessed portion. The recessed portion includes a second deepest portion at which a length from the first reference straight line to the recessed portion is maximum. The second deepest portion is located on the second reference straight line or located close to the front lip with respect to the second reference straight line.

5 Claims, 11 Drawing Sheets

(56) References Cited

U.S. PATENT DOCUMENTS

| | | | | |
|---|---|---|---|---|
| 2011/0289803 | A1* | 12/2011 | Folkerts | E02F 3/40 37/444 |
| 2012/0301258 | A1 | 11/2012 | Nagata et al. | |
| 2013/0323000 | A1* | 12/2013 | Rochel | E02F 9/2825 414/722 |
| 2016/0251821 | A1* | 9/2016 | Yoshida | E02F 3/40 414/685 |

FOREIGN PATENT DOCUMENTS

| | | | | | |
|---|---|---|---|---|---|
| CN | 104563175 | A | | 4/2015 | |
| JP | H05-067654 | U | | 9/1993 | |
| JP | H06-020546 | U | | 3/1994 | |
| JP | 2002-054171 | A | | 2/2002 | |
| JP | 2006-188870 | A | | 7/2006 | |
| JP | 3982584 | B2 | | 9/2007 | |
| JP | 2010-53590 | A | | 3/2010 | |
| JP | 2010053590 | A | * | 3/2010 | E02F 3/40 |
| JP | 2013-217067 | A | | 10/2013 | |
| WO | WO-2004/023001 | A1 | | 3/2004 | |
| WO | WO-2014/171024 | A1 | | 10/2014 | |

* cited by examiner

BUCKET AND WORK VEHICLE

TECHNICAL FIELD

The present disclosure relates to a bucket and a work vehicle.

BACKGROUND ART

For example, WO2004/023001 (PTL 1) discloses a bucket for an earthmoving machine.

CITATION LIST

Patent Literature

PTL 1: WO 2004/023001

SUMMARY OF INVENTION

Technical Problem

As disclosed in the above-mentioned PTL 1, a bucket is known that is mounted in a work vehicle such as a hydraulic excavator and used for excavating soil. Such a bucket is required to have an improved performance of penetration into the ground for achieving efficient excavation.

An object of the present disclosure is to provide a bucket allowing efficient excavation and a work vehicle including such a bucket.

Solution to Problem

A bucket according to the present disclosure is a bucket coupled to an arm of a work implement to be pivotable about a prescribed axis. The bucket includes a bottom plate, a pair of side plates, a bracket, and a front lip. The bottom plate faces an opening of the bucket. The pair of side plates is disposed to face each other on both sides of the bottom plate. The bracket is provided on a back surface of the bottom plate. The bracket is coupled to the arm on the prescribed axis. The front lip is provided along the opening. The front lip includes a front end portion. The front end portion defines an opening edge of the opening. The bottom plate includes a rear end portion. The rear end portion defines an opening edge of the opening on a side where the bracket is attached. Each of the side plates includes a side end portion. The side end portion defines an opening edge of the opening. The bottom plate further includes a first deepest portion. At the first deepest portion, a length from a first reference straight line to the bottom plate is maximum. The first reference straight line passes through the front end portion and a position at which the rear end portion is contiguous to each of the side plates. The first deepest portion is located on a second reference straight line orthogonal to the first reference straight line. The side end portion is provided with a recessed portion. The recessed portion is recessed in a direction toward the bottom plate in a side view seen from a direction along the prescribed axis. The recessed portion includes a second deepest portion. At the second deepest portion, a length from the first reference straight line to the recessed portion is maximum. The second deepest portion is located on the second reference straight line or located close to the front lip with respect to the second reference straight line.

A work vehicle according to the present disclosure includes a vehicular body and a work implement. The work implement is attached to the vehicular body. The work implement includes a boom, an arm, and the bucket. The boom is pivotably coupled to the vehicular body. The arm is pivotably coupled to the boom. The bucket is pivotably coupled to the arm.

Advantageous Effects of Invention

According to the present disclosure, a bucket allowing efficient excavation and a work vehicle including such a bucket can be provided.

DESCRIPTION OF EMBODIMENTS

Figure 1:
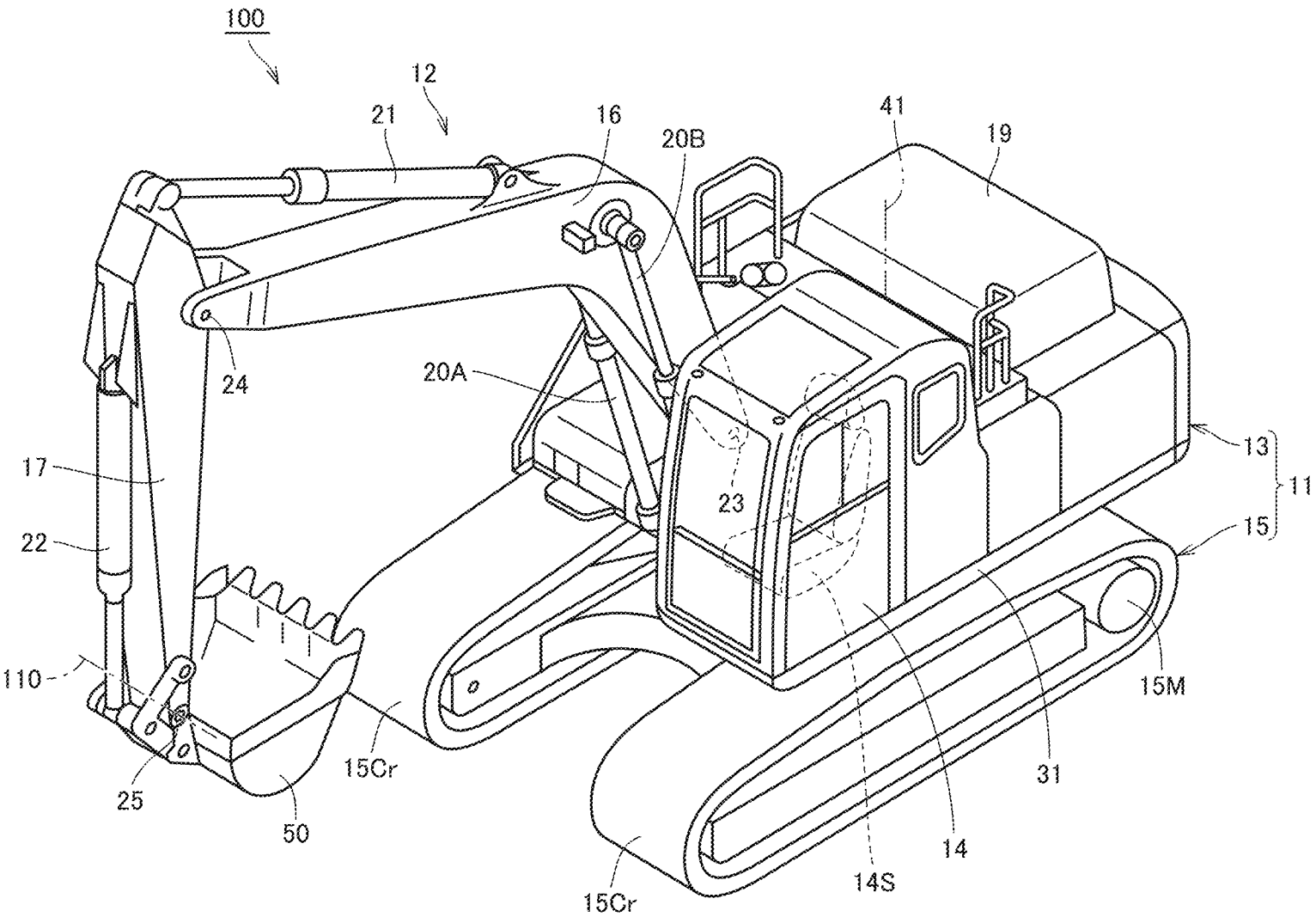
FIG. 1 is a perspective view showing a hydraulic excavator equipped with a bucket in the first embodiment of the present disclosure.

Embodiments of the present disclosure will be hereinafter described with reference to the accompanying drawings. In the drawings referred to below, the same or corresponding components will be denoted by the same reference characters.

First Embodiment

FIG. 1 is a perspective view showing a hydraulic excavator equipped with a bucket in the first embodiment of the present disclosure. As shown in FIG. 1, a hydraulic excavator 100 includes a vehicular body 11 and a work implement 12. Vehicular body 11 includes a revolving unit 13 and a traveling unit 15.

Traveling unit 15 includes a pair of crawler belts 15Cr and a travel motor 15M. Hydraulic excavator 100 can travel by rotation of crawler belts 15Cr. Travel motor 15M is provided as a drive source of traveling unit 15. Traveling unit 15 may include a wheel (tire).

Revolving unit 13 is provided on traveling unit 15. Revolving unit 13 can swing about the center of swing 41 with respect to traveling unit 15. The center of swing 41 corresponds to an axis extending in the up-down direction. Revolving unit 13 includes a cab (operator's cab) 14. Operator's cab 14 is provided with an operator's seat 14S on which an operator sits. The operator inside operator's cab 14 can operate hydraulic excavator 100.

Revolving unit 13 includes an engine compartment 19 and a counter weight that is provided in a rear portion of revolving unit 13. Engine compartment 19 accommodates an engine, a hydraulic oil tank, an air cleaner, a hydraulic pump, and the like.

Work implement 12 is attached to vehicular body 11. Work implement 12 is attached to revolving unit 13. Work implement 12 performs operations such as excavation of soil. Work implement 12 includes a boom 16, an arm 17, and a bucket 50.

Boom 16 is pivotably coupled to vehicular body 11 (revolving unit 13) through a boom pin 23. Arm 17 is pivotably coupled to boom 16 through an arm pin 24. Bucket 50 is pivotably coupled to arm 17 through a bucket pin 25. Bucket 50 is coupled to arm 17 to be pivotable about a center axis 110. Bucket pin 25 has a pin shape and extends along center axis 110. Center axis 110 corresponds to a pivot axis of bucket 50.

Work implement 12 further includes boom cylinders 20A and 20B, an arm cylinder 21, and a bucket cylinder 22.

Boom cylinders 20A and 20B, arm cylinder 21, and bucket cylinder 22 each are a hydraulic cylinder driven by hydraulic oil. Boom cylinders 20A and 20B, which are provided as one pair, each are provided on a corresponding one of both sides of boom 16, and operate boom 16 to pivot. Arm cylinder 21 operates arm 17 to pivot. Bucket cylinder 22 operates bucket 50 to pivot.

Boom 16, arm 17, and bucket 50 have pivot axes that extend in parallel with each other. The pivot axes of boom 16, arm 17, and bucket 50 each extend horizontally.

Hydraulic excavator 100 is a backhoe type configured such that bucket 50 is attached thereto so as to face an operator.

Figure 2:
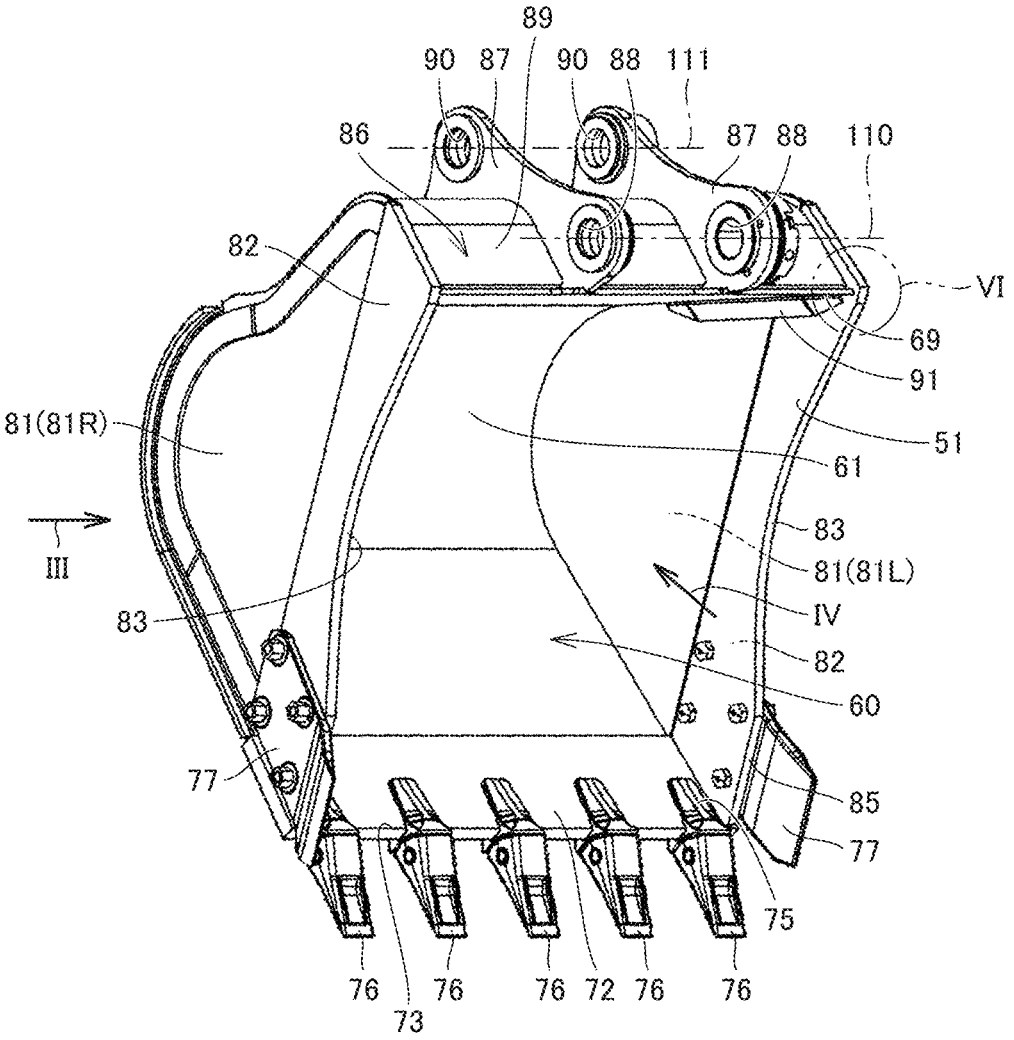
FIG. 2 is a perspective view showing the bucket.
Figure 3:
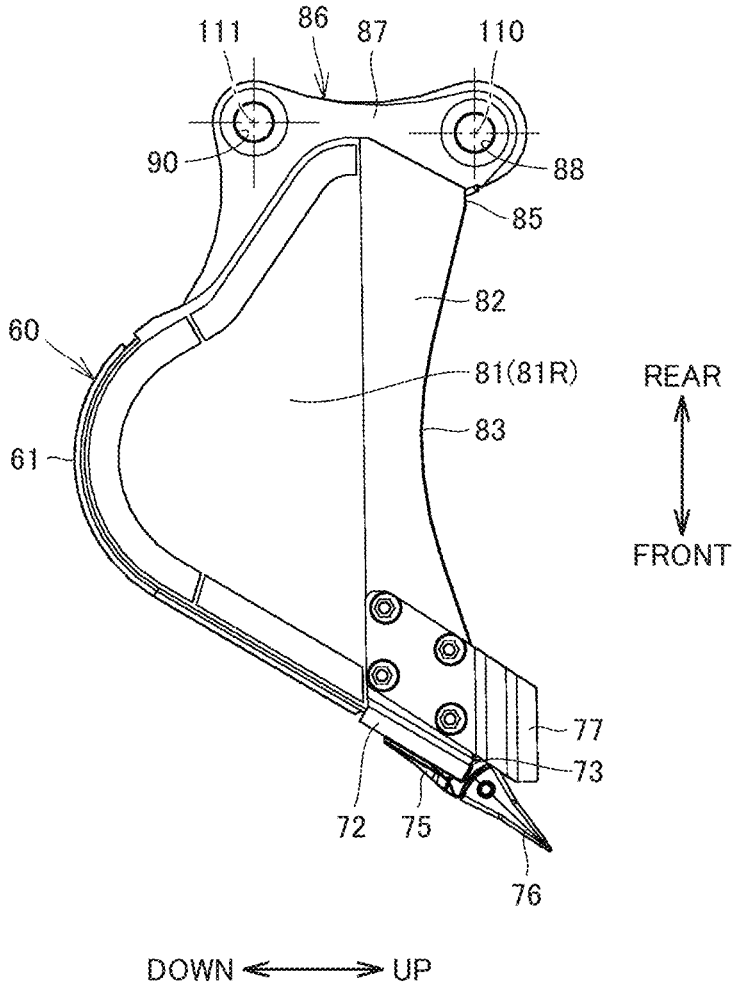
FIG. 3 is a side view showing the bucket as seen in the direction indicated by an arrow III in FIG. 2.
Figure 4:
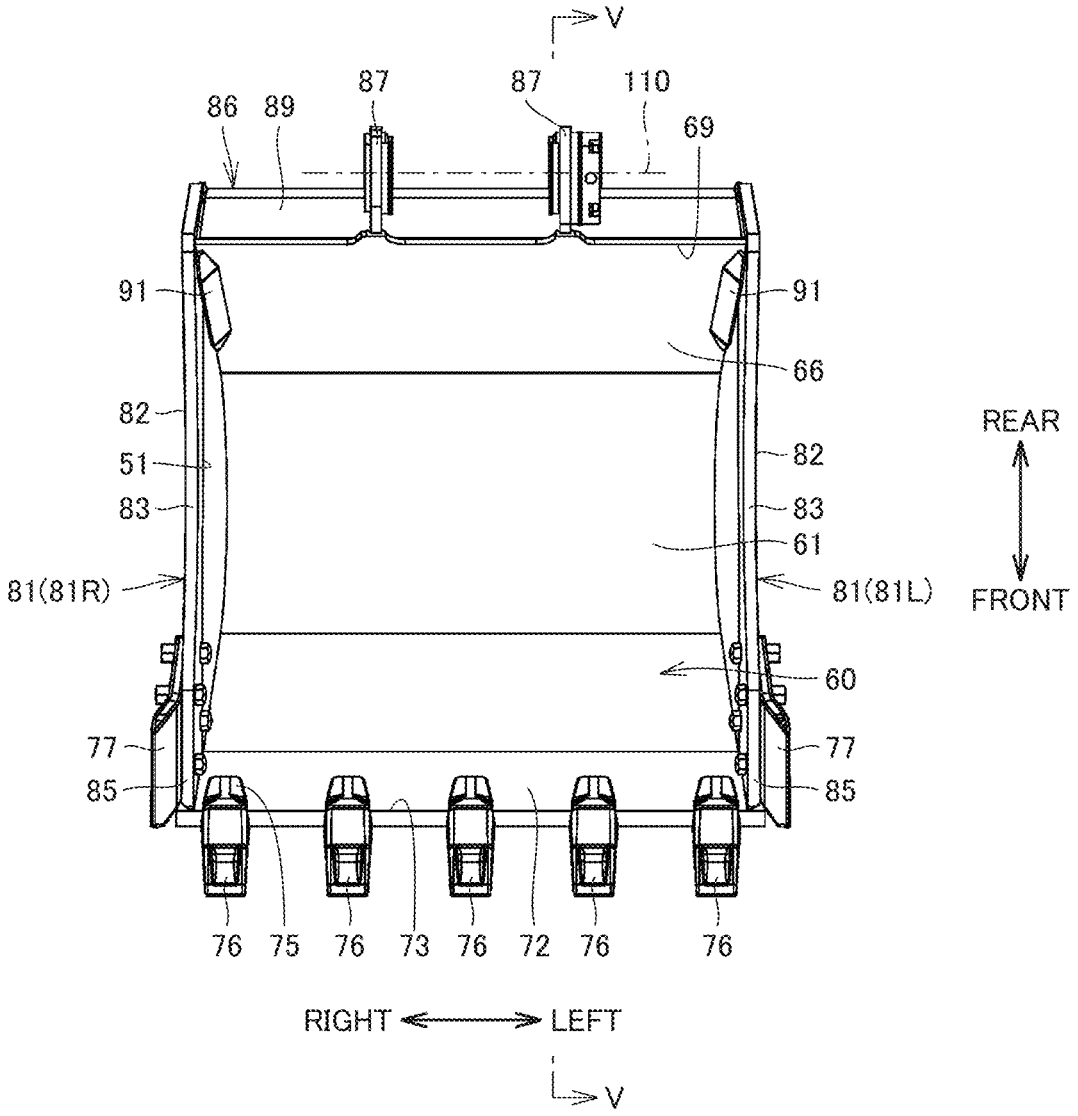
FIG. 4 is a top view showing the bucket as seen in the direction indicated by an arrow IV in FIG. 2.
Figure 5:
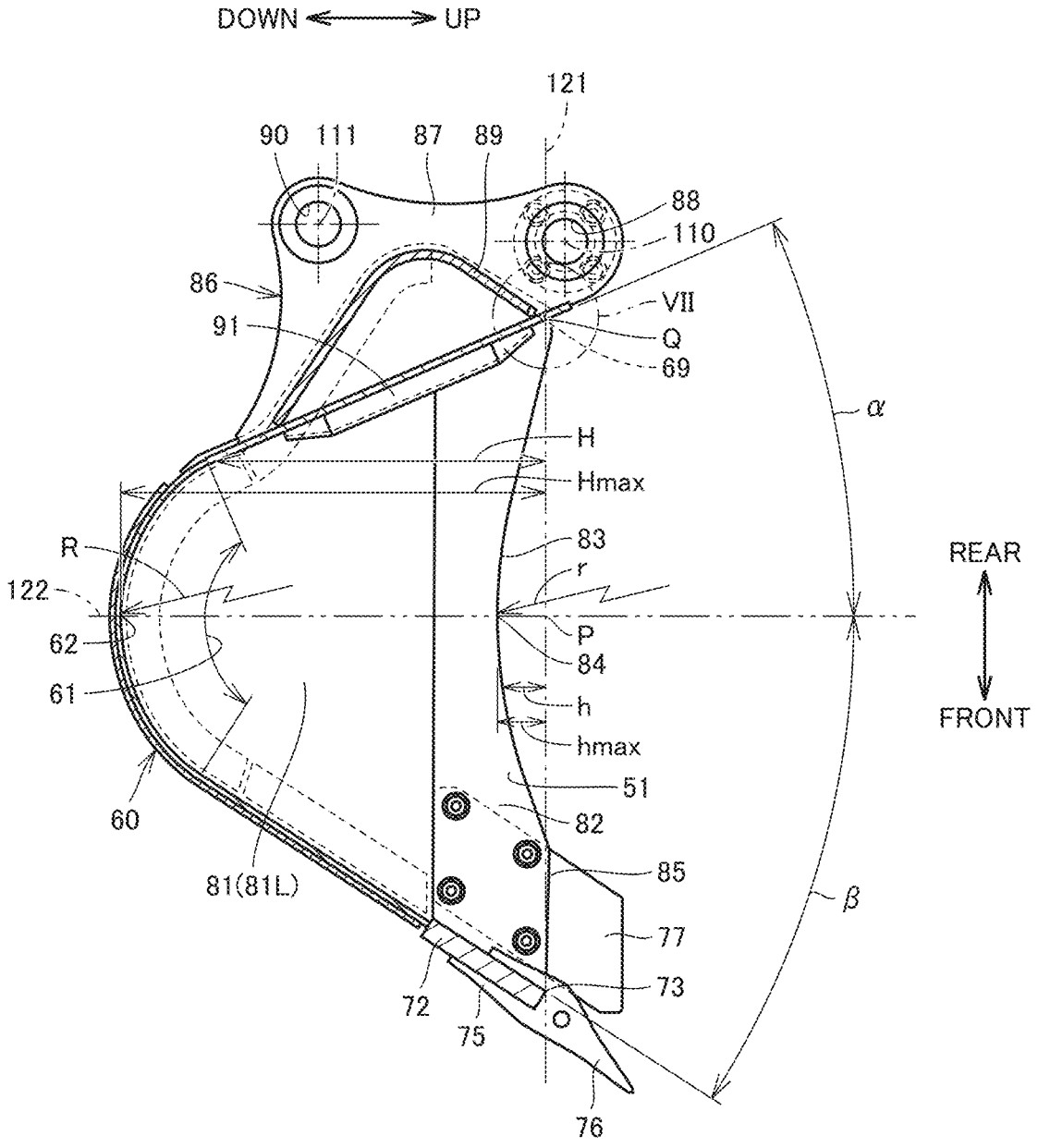
FIG. 5 is a cross-sectional view showing the bucket as seen in the direction indicated by an arrow line V-V in FIG. 4.

The structure of bucket 50 will then be described in detail. FIG. 2 is a perspective view showing the bucket. FIG. 3 is a side view showing the bucket as seen in the direction indicated by an arrow III in FIG. 2. FIG. 4 is a top view showing the bucket as seen in the direction indicated by an arrow IV in FIG. 2. FIG. 5 is a cross-sectional view showing the bucket as seen in the direction indicated by an arrow line V-V in FIG. 4.

As shown in FIGS. 2 to 5, bucket 50 forms a space in which excavated objects such as soil are loaded. Bucket 50 opens in one direction.

In the following description about the structure of buckets 50, the right-left direction corresponds to a direction in which the pivot axis (center axis 110) of bucket 50 extends. The front-rear direction corresponds to a direction orthogonal to the right-left direction. The side on which the pivot axis of bucket 50 exists corresponds to a rear side while the side opposite to the rear side corresponds to a front side. The right-hand side of bucket 50 that is disposed to face the front side corresponds to a right side while the left-hand side of bucket 50 that is disposed to face the front side corresponds to a left side. The up-down direction corresponds to a direction orthogonal to planes extending in the front-rear direction and the right-left direction. The side on which bucket 50 opens (has opening 51) corresponds to an upside while the side opposite to the upside corresponds to a downside. The above-mentioned directions are defined with respect to the posture of bucket 50 that is raised in the state where excavated objects such as soil are loaded in bucket 50.

Bucket 50 includes a bottom plate 60, a pair of side plates 81 (81L, 81R), a bracket 86, and a front lip 72. Bottom plate 60, the pair of side plates 81, and front lip 72 each are formed of a plate member. A space surrounded by bottom plate 60, the pair of side plates 81, and front lip 72 is provided such that excavated objects such as soil are loaded therein.

Bottom plate 60 faces opening 51 of bucket 50. Bottom plate 60 opens toward opening 51 in the up-down direction. The pair of side plates 81 is disposed to face each other on both sides of bottom plate 60. The pair of side plates 81 is connected to both ends of bottom plate 60 in the right-left direction. Side plates 81 are provided as one pair on the respective right and left sides. A side plate 81L is provided on the left side of bucket 50 while a side plate 81R is provided on the right side of bucket 50.

Bottom plate 60 is provided in parallel with the pivot axis of bucket 50 (center axis 110). Side plate 81 is provided in the direction crossing the pivot axis of bucket 50 (center axis 110). Side plate 81 is provided in the direction orthogonal to the pivot axis of bucket 50 (center axis 110).

The length of bucket 50 in the front-rear direction is increased toward the opening edge of opening 51 in the up-down direction. The area of the opening of the cross section of bucket 50 that is taken along a plane orthogonal to the up-down direction is increased toward the opening edge of opening 51 in the up-down direction.

Bottom plate 60 includes a bottom portion 61. Bottom portion 61 forms a bottom part of bottom plate 60 when viewed from opening 51. Bottom portion 61 has a curved shape in a side view seen in the axial direction of center axis 110 (a view seen in the right-left direction as side views shown in FIGS. 3 and 5, which will be hereinafter simply referred to as a "side view"). Bottom portion 61 has a cross section formed in a mound shape (a circular arc shape) protruding downward in a view of a cross section taken along a plane orthogonal to center axis 110.

In a view of a cross section taken along the plane orthogonal to center axis 110, bottom plate 60 has a linear-shaped cross section that extends obliquely upward in the frontward direction from the end of bottom portion 61 on the front side toward the opening edge of opening 51. In a view of a cross section taken along the plane orthogonal to center axis 110, bottom plate 60 has a linear-shaped cross section that extends obliquely upward in the rearward direction from the end of bottom portion 61 on the rear side toward the opening edge of opening 51.

Bracket 86 is provided on the back surface (the outer surface on the rear side) of bottom plate 60. Bracket 86 is a member for coupling bucket 50 to work implement 12 (arm 17) in FIG. 1. Bracket 86 is coupled to arm 17 on center axis 110.

Bracket 86 includes a base member 89 and a plurality of plates 87. Base member 89 is connected to bottom plate 60 from the outside of bucket 50. Base member 89 has a cross section formed in a mound shape protruding rearward from bottom plate 60 and extends in a plate shape in the right-left direction. Plate 87 is connected to base member 89. Plate 87 is formed of a plate member having a thickness extending in the right-left direction. Plate 87 extends to protrude rearward from base member 89. The plurality of plates 87 are spaced apart from each other in the right-left direction.

Bracket 86 is provided with holes 88 and 90. Hole 88 is provided to pass through plate 87 in the right-left direction (in the thickness direction of plate 87). Hole 88 is provided to pass through the plurality of plates 87 in the right-left direction. Hole 88 has its center on center axis 110 serving as a pivot axis of bucket 50. Hole 88 has a circular opening centering on center axis 110. Bucket pin 25 is inserted into hole 88, and thereby, bucket 50 is coupled to arm 17 to be pivotable about center axis 110 (also see FIG. 1).

Hole 90 is provided to pass through plate 87 in the right-left direction (in the thickness direction of plate 87). Hole 90 is provided to pass through the plurality of plates 87 in the right-left direction. Hole 90 has its center on a center axis 111. Hole 90 has a circular opening centering on center axis 111. Center axis 111 extends in parallel with center axis 110. Center axis 111 is located below center axis 110. A pin for coupling bucket 50 to bucket cylinder 22 in FIG. 1 is inserted into hole 90.

Front lip 72 is provided along opening 51 to be located in bottom plate 60 to face bracket 86. Front lip 72 faces bracket 86 in the front-rear direction. Front lip 72 is connected to the end of bottom plate 60 on the front side. In a side view, front lip 72 has a prescribed thickness and linearly extends obliquely upward in the frontward direction. Front lip 72 is formed of a plate member having a prescribed thickness. Front lip 72 is greater in thickness than bottom plate 60. A tooth 76 is connected to front lip 72 via a tooth adapter 75.

Front lip 72 includes a front end portion 73. Front end portion 73 defines an opening edge of opening 51 on the front side of bucket 50. Front end portion 73 corresponds to a tip end (an upper end) portion of front lip 72 when viewed from bottom portion 61. Front end portion 73 is located at the uppermost position in front lip 72.

Bottom plate 60 includes a rear end portion 69. Rear end portion 69 defines an opening edge of opening 51 on the side where bracket 86 is attached. Rear end portion 69 defines an opening edge of opening 51 on the rear side of bucket 50. Rear end portion 69 is a tip end (upper end) portion of bottom plate 60 on the rear side when viewed from bottom portion 61.

Each side plate 81 is connected to a corresponding one of both ends of bottom plate 60 in the axial direction of center axis 110. Side plate 81 is formed of a plate member having a thickness extending in the right-left direction (in the axial direction of center axis 110).

Side plate 81 includes a side lip 82. Side lip 82 is provided along opening 51. Side lip 82 is provided at the same height as front lip 72 in the up-down direction. Side lip 82 is formed of a plate member having a prescribed thickness. Side lip 82 is greater in thickness than other portions of side plate 81. A side cutter 77 is fixed to side lip 82. Side cutter 77 is provided at a position closer to front lip 72 than to bracket 86 in the front-rear direction.

Side plate 81 (81L, 81R) has a side end portion 85. Side end portion 85 defines an opening edge of opening 51 on each of the right and left sides of bucket 50. Side end portion 85 is a tip end (an upper end) portion of side plate 81 (side lip 82) when viewed from bottom portion 61.

Side end portion 85 is provided with a recessed portion 83. Recessed portion 83 has a shape recessed in the direction toward bottom plate 60 in a side view. Recessed portion 83 is provided to extend across both the front and rear sides with respect to a second reference straight line 122 (described later). Recessed portion 83 is provided at a position other than the position of side cutter 77.

A reinforcement member 91 is provided in a corner portion formed between side plate 81 (81L, 81R) and bottom plate 60. Reinforcement member 91 is provided inside bucket 50. Reinforcement member 91 is provided on bottom plate 60 on the side where bracket 86 is attached.

Figure 6:
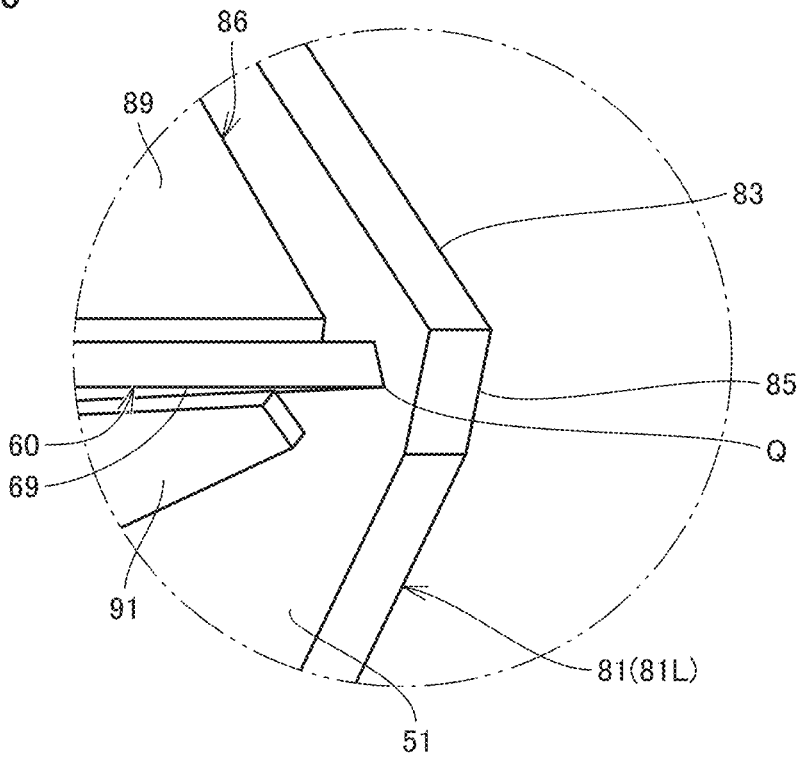
FIG. 6 is a perspective view showing a range surrounded by a long dashed double-dotted line VI in FIG. 2 in an enlarged manner.
Figure 7:
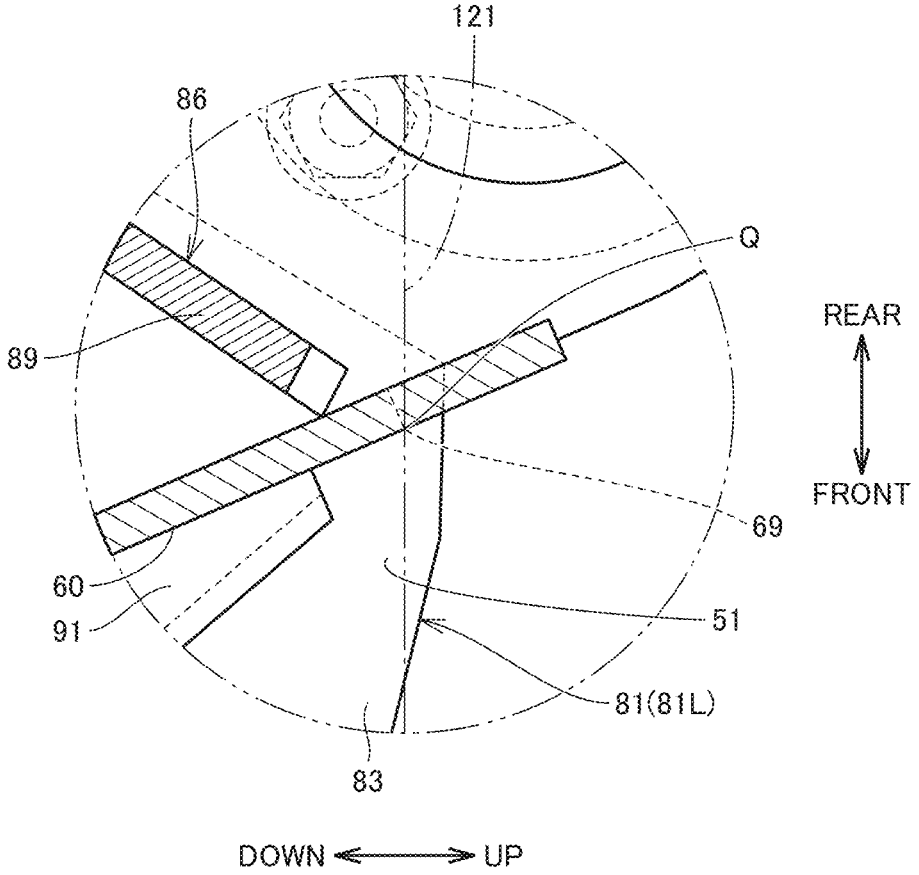
FIG. 7 is a cross-sectional view showing a range surrounded by a long dashed double-dotted line VII in FIG. 5 in an enlarged manner.

FIG. 6 is a perspective view showing a range surrounded by a long dashed double-dotted line VI in FIG. 2 in an enlarged manner. FIG. 7 is a cross-sectional view showing a range surrounded by a long dashed double-dotted line VII in FIG. 5 in an enlarged manner.

As shown in FIGS. 5 to 7, a first reference straight line 121 is defined that passes through a position Q at which rear end portion 69 is contiguous to side plate 81 and through front end portion 73 of front lip 72.

As shown in FIG. 5, a length H from first reference straight line 121 to bottom plate 60 varies in the linear direction along first reference straight line 121.

Bottom plate 60 includes a first deepest portion 62. First deepest portion 62 is a part of bottom portion 61. At first deepest portion 62, length H from first reference straight line 121 to bottom plate 60 has a maximum value (Hmax). First deepest portion 62 is a deepest portion inside bucket 50 with respect to first reference straight line 121. In the linear direction along first reference straight line 121, length H from first reference straight line 121 to bottom plate 60 is decreased from first deepest portion 62 toward the front side and also decreased from first deepest portion 62 toward the rear side.

Second reference straight line 122 is defined that passes through first deepest portion 62 and extends orthogonal to first reference straight line 121. Recessed portion 83 is located on second reference straight line 122. Hmax corresponds to the length of second reference straight line 122 from first reference straight line 121 to first deepest portion 62.

A length h from first reference straight line 121 to recessed portion 83 varies in the linear direction along first reference straight line 121.

Recessed portion 83 includes a second deepest portion 84. At second deepest portion 84, length h from first reference straight line 121 to recessed portion 83 has a maximum value (hmax). Second deepest portion 84 is recessed most in recessed portion 83 with respect to first reference straight line 121. In the linear direction along first reference straight line 121, length h from first reference straight line 121 to recessed portion 83 is decreased from second deepest portion 84 toward the front side and decreased from second deepest portion 84 toward the rear side.

Second deepest portion 84 is located on second reference straight line 122 or located close to front lip 72 with respect to second reference straight line 122 in the linear direction along first reference straight line 121. Second deepest portion 84 is located on second reference straight line 122. First deepest portion 62 and second deepest portion 84 are located on the same straight line (second reference straight line 122) that is orthogonal to first reference straight line 121. In this case, hmax corresponds to the length of second reference straight line 122 from first reference straight line 121 to second deepest portion 84.

Bottom plate 60 has a curved shape having a curvature 1/R (a radius of curvature R) in first deepest portion 62. Recessed portion 83 has a curved shape having a curvature 1/r (a radius of curvature r) in second deepest portion 84. Curvature 1/r of recessed portion 83 in second deepest portion 84 is equal to or greater than curvature 1/R of bottom plate 60 in first deepest portion 62 ($1/r \geq 1/R$). Curvature 1/r of recessed portion 83 in second deepest portion 84 is the same as curvature 1/R of bottom plate 60 in first deepest portion 62 ($1/r = 1/R$).

Also, an angle β formed between second reference straight line 122 and front lip 72 is greater than an angle α formed between second reference straight line 122 and first inclined portion 67 (β>α).

Figure 8:
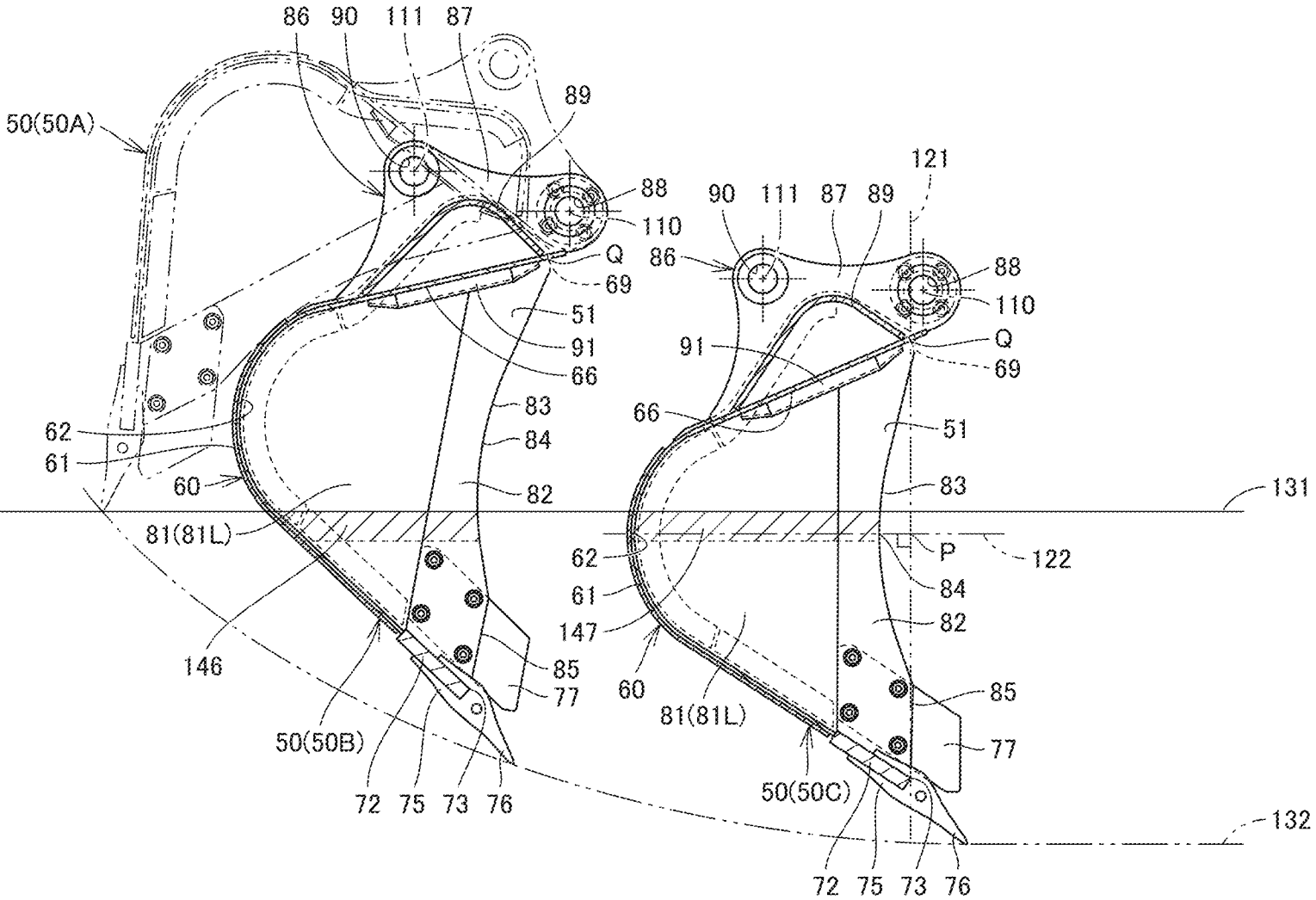
FIG. 8 is a side view showing an example of an operation of the bucket during excavation of soil in the first embodiment.

FIG. 8 is a side view showing an example of an operation of the bucket during excavation of soil in the first embodiment. As shown in FIGS. 1 and 8, boom cylinders 20A and 20B, arm cylinder 21, and bucket cylinder 22 are driven to thereby operate boom 16, arm 17, and bucket 50 to pivot for excavation of soil (ditch digging).

In FIG. 8, a solid line 131 shows the ground surface before excavation, and a long dashed double-dotted line 132 shows the ground surface after excavation. As excavation progresses, bucket 50 is moved sequentially through the positions shown by a bucket 50A, a bucket 50B, and a bucket 50C in this order.

First, the tip end of tooth 76 is brought into contact with the ground surface (bucket 50A). Then, bucket 50 is operated to pivot about center axis 110, to thereby cause bucket 50 to penetrate into the ground while tooth 76 is positioned as a leading edge (bucket 50B). Then, while bucket 50 is operated to pivot about center axis 110, boom 16 and arm 17 are operated to pivot to thereby move bucket 50 horizontally in the direction toward cab 14 (bucket 50C). Then, bucket 50 in which excavated soil is loaded is raised from the ground surface.

As a typical example, while bucket 50 moves horizontally as shown by bucket 50C in FIG. 8, bucket 50 adopts a posture such that first reference straight line 121 extends in the vertical direction and second reference straight line 122 extends in the horizontal direction. At this time, front lip 72 and the front side of bottom plate 60 move through the underground below the ground surface while the rear side of bottom plate 60 moves above the ground surface.

When bucket 50 is caused to penetrate into the ground, side plate 81 needs to push away soil so as to dig into the ground. In this case, side plate 81 may increase the resistance caused during penetration of bucket 50 (penetration resistance). Furthermore, a portion of side plate 81 that digs into the ground is changed in position sequentially from a region along a straight line that connects the front side of bottom plate 60 and side end portion 85 (a hatched region 146 in bucket 50B) to a region along a straight line that connects bottom portion 61 and side end portion 85 (a hatched region 147 in bucket 50C).

For addressing the above-described situation, side end portion 85 of side plate 81 is provided with recessed portion 83. This reduces the length of a portion of side plate 81 that digs into the ground (the length of the above-mentioned hatched region 147), so that an increase in penetration resistance resulting from side plate 81 can be effectively suppressed. Furthermore, in the excavation work performed using bucket 50, it is assumed that front lip 72 and the front side of bottom plate 60 are often inserted into the ground. Thus, second deepest portion 84 of recessed portion 83 is located on second reference straight line 122 or located close to front lip 72 with respect to second reference straight line 122, and thereby, the length of side plate 81 can be more effectively reduced at the position where insertion into the ground is assumed to often occur. As a result, the penetration performance of bucket 50 into the ground can be improved, thereby allowing efficient excavation.

Since the length of side plate 81 in the up-down direction is maximum on second reference straight line 122 that passes through first deepest portion 62 of bottom plate 60, side plate 81 on second reference straight line 122 most significantly influences an increase in penetration resistance. Particularly when second deepest portion 84 of recessed portion 83 is located on second reference straight line 122 that passes through first deepest portion 62 of bottom plate 60, the length of side plate 81 on second reference straight line 122 becomes shortest due to recessed portion 83. This can more effectively suppress an increase in the penetration resistance resulting from side plate 81. Furthermore, as the portion of side plate 81 that digs into the ground is changed in position sequentially in the above-mentioned order, the length of side plate 81 changes, so that the excavation resistance changes accordingly. For addressing such a situation, first deepest portion 62 of bottom plate 60 and second deepest portion 84 of recessed portion 83 are located on second reference straight line 122, and thereby, the length of the portion of side plate 81 that digs into the ground can be gently changed between: the time when side plate 81 on second reference straight line 122 penetrates into the ground; and the time when side plate 81 at the position displaced from second reference straight line 122 in the front-rear direction penetrates into the ground. This can suppress an excessive change in magnitude of the penetration resistance resulting from side plate 81, thereby allowing smooth excavation of soil.

Furthermore, curvature 1/r of second deepest portion 84 is equal to or greater than curvature 1/R of first deepest portion 62. By the configuration as described above, recessed portion 83 in second deepest portion 84 can be more largely recessed, with the result that the length of side plate 81 on second reference straight line 122 that passes through first deepest portion 62 can be further more effectively reduced. Thereby, the penetration performance of bucket 50 into the ground can be further improved. Particularly when curvature 1/r of second deepest portion 84 is the same as curvature 1/R of first deepest portion 62, both of the effects can be achieved to improve the penetration performance of bucket 50 into the ground, and to suppress an excessive change in magnitude of the penetration resistance resulting from side plate 81.

It should be noted that curvature 1/r of second deepest portion 84 may be smaller than curvature 1/R of first deepest portion 62. In this case, the length of side plate 81 can be reduced in a wider range of the position displaced from second reference straight line 122 in the front-rear direction. Thus, even in the case where the excavation work performed using bucket 50 includes a process in which not only front lip 72 and the front side of bottom plate 60 but also a part of bottom plate 60 on the rear side need to be inserted into the ground, an increase in penetration resistance resulting from side plate 81 can be effectively suppressed.

The following is a summarized explanation about the configuration and the effect of bucket 50 and hydraulic excavator 100 in the present embodiment.

Bucket 50 according to the present disclosure is coupled to arm 17 of work implement 12 to be pivotable about center axis 110 as a prescribed axis. Bucket 50 includes bottom plate 60, a pair of side plates 81, bracket 86, and front lip 72. Bottom plate 60 faces opening 51 of bucket 50. The pair of side plates 81 is disposed to face each other on both sides of bottom plate 60. Bracket 86 is provided on the back surface of bottom plate 60. Bracket 86 is coupled to arm 17 on center axis 110. Front lip 72 is provided along opening 51. Front lip 72 includes front end portion 73. Front end portion 73 defines the opening edge of opening 51. Bottom plate 60 includes rear end portion 69. Rear end portion 69 defines the opening edge of opening 51 on the side where bracket 86 is attached. Side plate 81 includes side end portion 85. Side end portion 85 defines the opening edge of opening 51.

Bottom plate 60 further includes first deepest portion 62. At first deepest portion 62, the length from first reference straight line 121 to bottom plate 60 is maximum. First reference straight line 121 passes through front end portion 73 and position Q at which rear end portion 69 is contiguous to side plate 81. First deepest portion 62 is located on second reference straight line 122 orthogonal to first reference straight line 121. Side end portion 85 is provided with recessed portion 83. In a side view seen in the axial direction of center axis 110, recessed portion 83 is recessed in the direction toward bottom plate 60. Recessed portion 83 includes second deepest portion 84. At second deepest portion 84, the length from first reference straight line 121 to recessed portion 83 is maximum. Second deepest portion 84 is located on second reference straight line 122 or located close to front lip 72 with respect to second reference straight line 122.

According to the configuration as described above, side end portion 85 of side plate 81 is provided with recessed portion 83, so that an increase in penetration resistance resulting from side plate 81 can be effectively suppressed. Furthermore, second deepest portion 84 of recessed portion 83 is located on second reference straight line 122 or located close to front lip 72 with respect to second reference straight line 122, and thereby, the length of side plate 81 can be more effectively reduced at the position where insertion into the ground is assumed to often occur. Thereby, the penetration performance of bucket 50 into the ground can be improved, thereby allowing efficient excavation.

Furthermore, second deepest portion 84 is located on second reference straight line 122. According to the configuration as described above, the length of side plate 81 on second reference straight line 122 that passes through first deepest portion 62 of bottom plate 60 becomes shortest due to recessed portion 83. Thereby, an increase in the penetration resistance resulting from side plate 81 can be more effectively suppressed.

Furthermore, bottom plate 60 has a curved shape having curvature 1/R as the first curvature in first deepest portion 62. Recessed portion 83 has a curved shape having 1/r as the second curvature in second deepest portion 84, in which curvature 1/r is equal to or greater than curvature 1/R.

According to the configuration as described above, the length of side plate 81 on second reference straight line 122 that passes through first deepest portion 62 can be more effectively reduced. Thereby, the penetration performance of bucket 50 into the ground can be further improved.

Furthermore, curvature 1/R of bottom plate 60 in first deepest portion 62 is the same as curvature 1/r of recessed portion 83 in second deepest portion 84.

The configuration as described above can suppress a difference in length of a portion of side plate 81, which digs into the ground, between the time when side plate 81 on second reference straight line 122 penetrates into the ground, and the time when side plate 81 at the position displaced from second reference straight line 122 in the front-rear direction penetrates into the ground. Thereby, both of the effects can be achieved to improve the penetration performance of bucket 50 into the ground, and to suppress an excessive change in magnitude of the penetration resistance resulting from side plate 81.

Furthermore, curvature 1/r of recessed portion 83 in second deepest portion 84 may be smaller than curvature 1/R of bottom plate 60 in first deepest portion 62.

The configuration as described above can effectively suppress an increase in penetration resistance resulting from side plate 81 in a wider range of the position displaced from second reference straight line 122 in the front-rear direction.

Hydraulic excavator 100 includes vehicular body 11 and work implement 12. Work implement 12 is attached to vehicular body 11. Work implement 12 includes boom 16, arm 17, and bucket 50. Boom 16 is pivotably coupled to vehicular body 11. Arm 17 is pivotably coupled to boom 16. Bucket 50 is pivotably coupled to arm 17.

According to the configuration as described above, the penetration performance of bucket 50 into the ground can be improved, thereby allowing more efficient excavation by hydraulic excavator 100.

Second Embodiment

Figure 9:
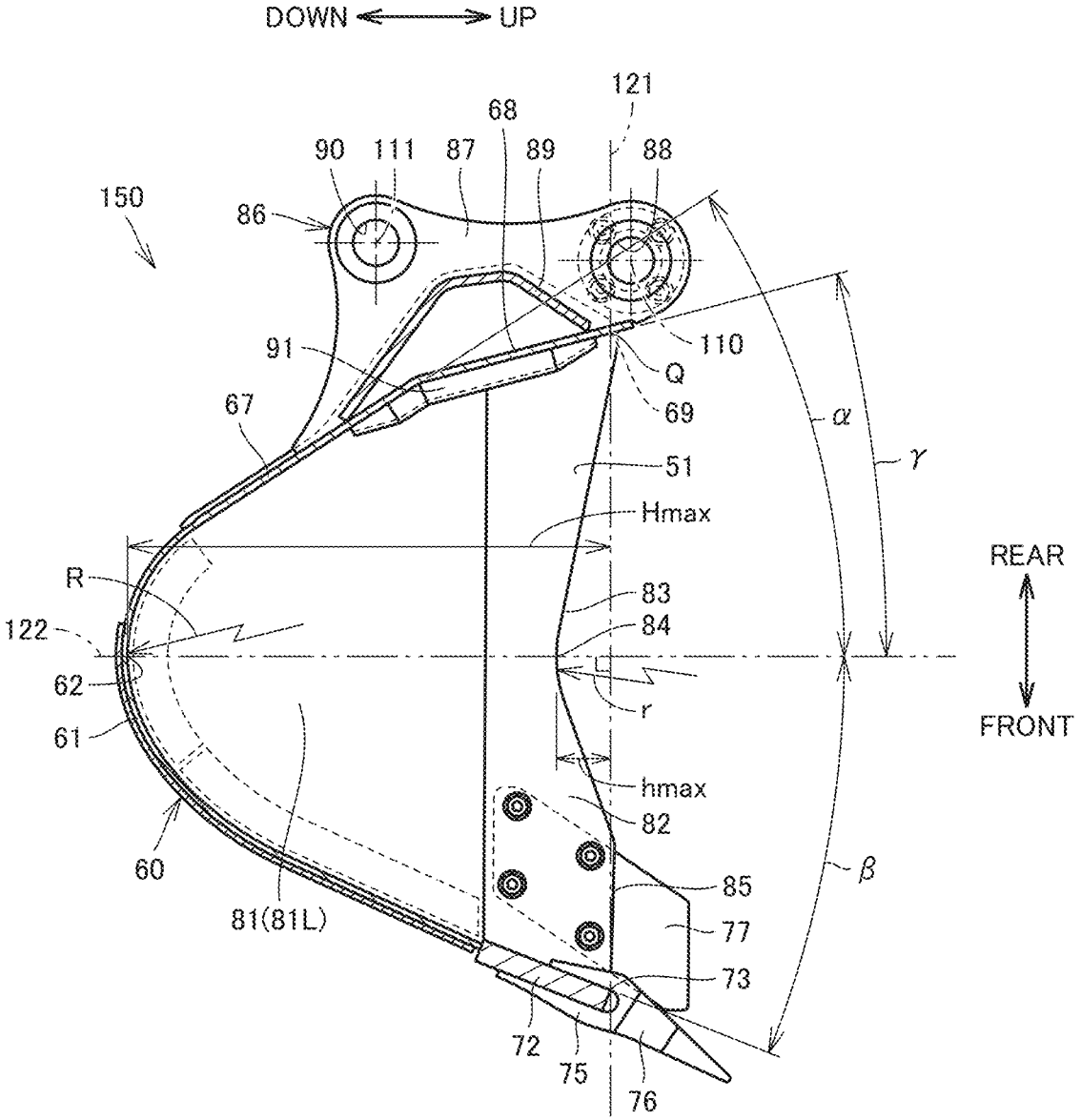
FIG. 9 is a cross-sectional view showing a bucket in the second embodiment of the present disclosure.

FIG. 9 is a cross-sectional view showing a bucket in the second embodiment of the present disclosure. FIG. 9 corresponds to FIG. 5 in the first embodiment. A bucket 150 in the present embodiment has basically the same structure as that of bucket 50 in the first embodiment. In the following, the description of the same configuration will not be repeated.

As shown in FIG. 9, bucket 150 includes a bottom plate 60, a pair of side plates 81, a bracket 86, and a front lip 72.

Front lip 72 includes a front end portion 73. Bottom plate 60 includes a rear end portion 69. Side plates 81 each include a side end portion 85. Side end portion 85 is provided with a recessed portion 83. Bottom plate 60 includes a first deepest portion 62 at which a length from first reference straight line 121 to bottom plate 60 is maximum. First reference straight line 121 passes through front end portion 73 and a position Q at which rear end portion 69 is contiguous to side plate 81. First deepest portion 62 is located on a second reference straight line 122 orthogonal to first reference straight line 121. Recessed portion 83 includes a second deepest portion 84 at which a length from first reference straight line 121 to recessed portion 83 is maximum. Second deepest portion 84 is located on second reference straight line 122 or located close to front lip 72 with respect to second reference straight line 122 in the linear direction along first reference straight line 121. Second deepest portion 84 is located on second reference straight line 122.

Bottom plate 60 includes a first inclined portion 67 and a second inclined portion 68. First inclined portion 67 and second inclined portion 68 are provided on the side where bracket 86 is attached. First inclined portion 67 is contiguous to bottom portion 61. First inclined portion 67 linearly extends obliquely upward in the rearward direction from the end of bottom portion 61 on the rear side. Second inclined portion 68 is contiguous to first inclined portion 67. Second inclined portion 68 is provided along an opening 51. Second inclined portion 68 is bent at first inclined portion 67 and extends to the opening edge of opening 51. Second inclined portion 68 extends linearly from first inclined portion 67 obliquely upward in the rearward direction at an inclination different from that of first inclined portion 67. In a side view, bottom plate 60 has a bent shape that is bent at the boundary between first inclined portion 67 and second inclined portion 68.

Also, an angle $\beta$ formed between second reference straight line 122 and front lip 72 is smaller than an angle $\alpha$ formed between second reference straight line 122 and first inclined portion 67 ($\beta<\alpha$). In other words, angle $\alpha$ formed between second reference straight line 122 and first inclined portion 67 is larger than angle $\beta$ formed between second reference straight line 122 and front lip 72.

Also, an angle γ formed between second reference straight line 122 and second inclined portion 68 is smaller than angle α formed between second reference straight line 122 and first inclined portion 67 (γ<α).

Figure 10:
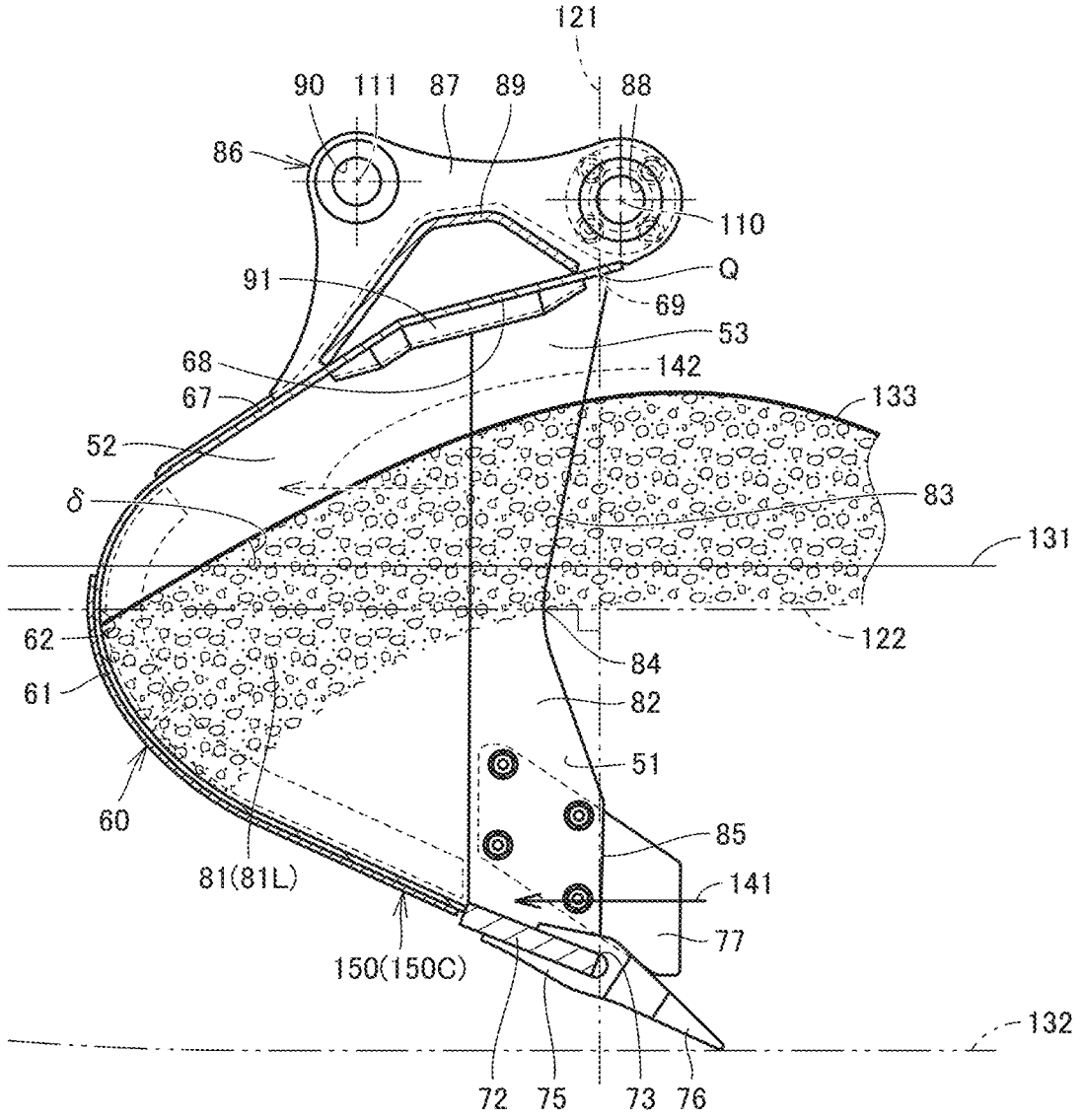
FIG. 10 is a side view showing an example of an operation of the bucket during excavation of soil in the second embodiment.

FIG. 10 is a side view showing an example of an operation of the bucket during excavation of soil in the second embodiment. Bucket 150 (150C) shown in FIG. 10 corresponds to bucket 50 (50C) in FIG. 8 in the first embodiment.

As shown in FIGS. 9 and 10, in bucket 150, angle β formed between second reference straight line 122 and front lip 72 is smaller than angle α formed between second reference straight line 122 and first inclined portion 67, with the result that the angle formed between front lip 72 and the moving direction of bucket 150 can be set smaller. Thereby, when front lip 72 and the front side of bottom plate 60 are moved through the underground, soil can be efficiently moved into bucket 150 through front lip 72, as indicated by an arrow 141.

On the other hand, on the ground above the ground surface, as indicated by a solid line 133 in FIG. 10, the soil having a shape bulging from the ground surface at an angle of repose δ is moved into a region 52 inside bucket 150 directly below first inclined portion 67. In this case, when first inclined portion 67 is inclined at an excessively small angle relative to the moving direction of bucket 150, first inclined portion 67 may prevent soil from being moved into region 52. For addressing such a situation, in bucket 150, angle α formed between second reference straight line 122 and first inclined portion 67 is larger than angle β formed between second reference straight line 122 and front lip 72, which prevents an excessively small inclination of first inclined portion 67. Thereby, the soil having a shape bulging from the ground surface can be efficiently moved into region 52, as indicated by an arrow 142.

For the reasons as described above, the amount of soil loaded into bucket 150 can be increased, thereby allowing more efficient excavation.

Furthermore, in bucket 150, angle γ formed between second reference straight line 122 and second inclined portion 68 is smaller than angle α formed between second reference straight line 122 and first inclined portion 67. Thereby, soil is moved into region 53 inside bucket 150 directly below second inclined portion 68 such that region 53 is entirely filled with the soil. This can prevent formation of a dead space inside bucket 150 when bucket 150 is raided from the ground surface.

According to bucket 150 in the second embodiment of the present disclosure configured as described above, the same effect as that in the first embodiment can be achieved.

Third Embodiment

Figure 11:
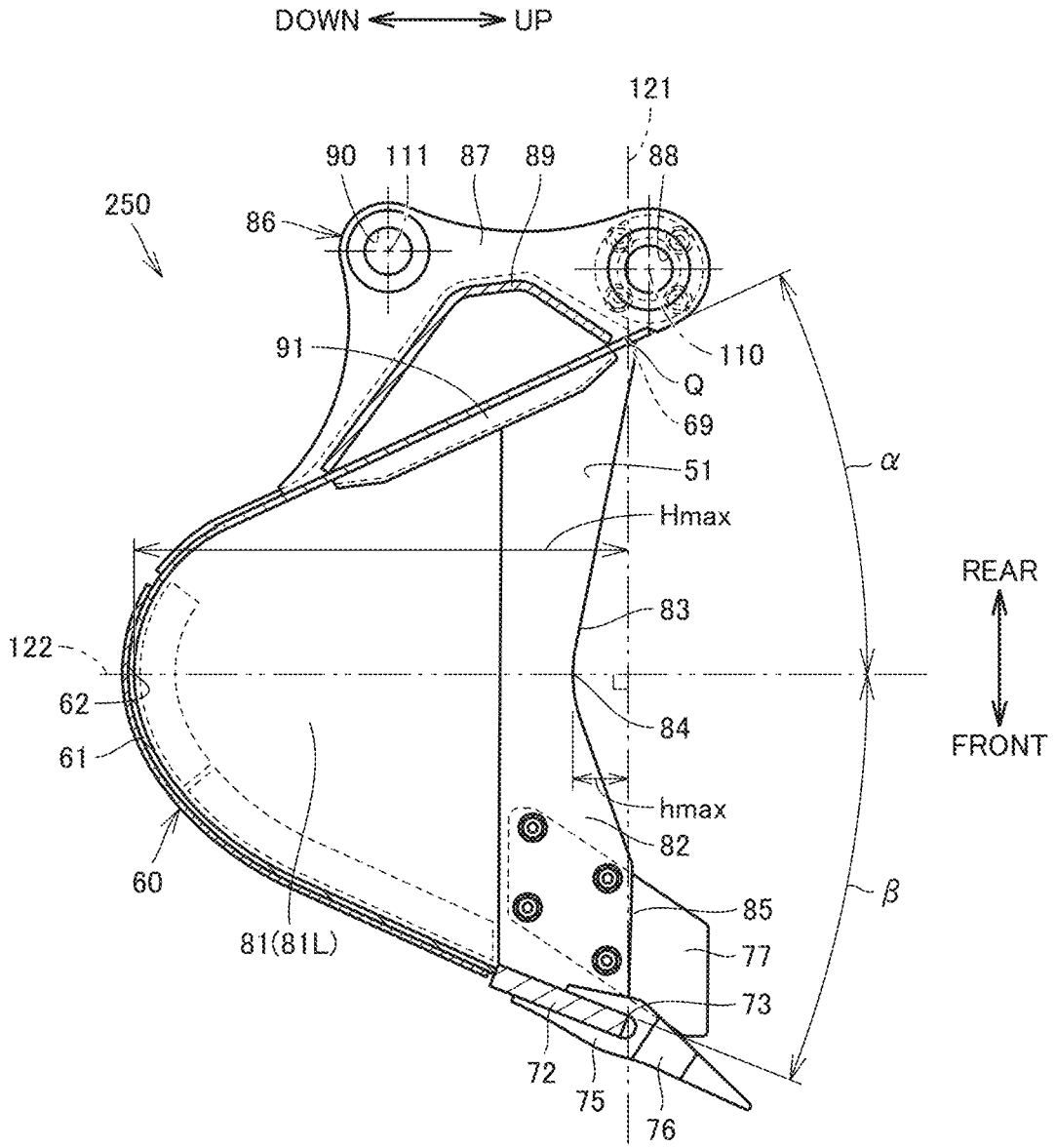
FIG. 11 is a cross-sectional view showing a bucket in the third embodiment of the present disclosure.

FIG. 11 is a cross-sectional view showing a bucket in the third embodiment of the present disclosure. FIG. 11 corresponds to FIG. 5 in the first embodiment. A bucket 250 in the present embodiment has basically the same structure as that of bucket 50 in the first embodiment. In the following, the description of the same configuration will not be repeated.

As shown in FIG. 11, bucket 250 includes a bottom plate 60, a pair of side plates 81, a bracket 86, and a front lip 72.

Front lip 72 includes a front end portion 73. Bottom plate 60 includes a rear end portion 69. Side plates 81 each include a side end portion 85. Side end portion 85 is provided with a recessed portion 83. Bottom plate 60 includes a first deepest portion 62 at which a length from first reference straight line 121 to bottom plate 60 is maximum. First reference straight line 121 passes through front end portion 73 and a position Q at which rear end portion 69 is contiguous to side plate 81. First deepest portion 62 is located on a second reference straight line 122 orthogonal to first reference straight line 121. Recessed portion 83 includes a second deepest portion 84 at which a length from first reference straight line 121 to recessed portion 83 is maximum. Second deepest portion 84 is located on second reference straight line 122 or located close to front lip 72 with respect to second reference straight line 122 in the linear direction along first reference straight line 121. Second deepest portion 84 is located on second reference straight line 122.

In this case, an angle β formed between second reference straight line 122 and front lip 72 is smaller than an angle α formed between second reference straight line 122 and bottom plate 60 on the side where bracket 86 is attached (β<α). In other words, angle α formed between second reference straight line 122 and bottom plate 60 on the side where bracket 86 is attached is larger than angle β formed between second reference straight line 122 and front lip 72.

According to bucket 250 in the third embodiment of the present disclosure configured as described above, the same effects as those in the first and second embodiments can be achieved.

Fourth Embodiment

Figure 12:
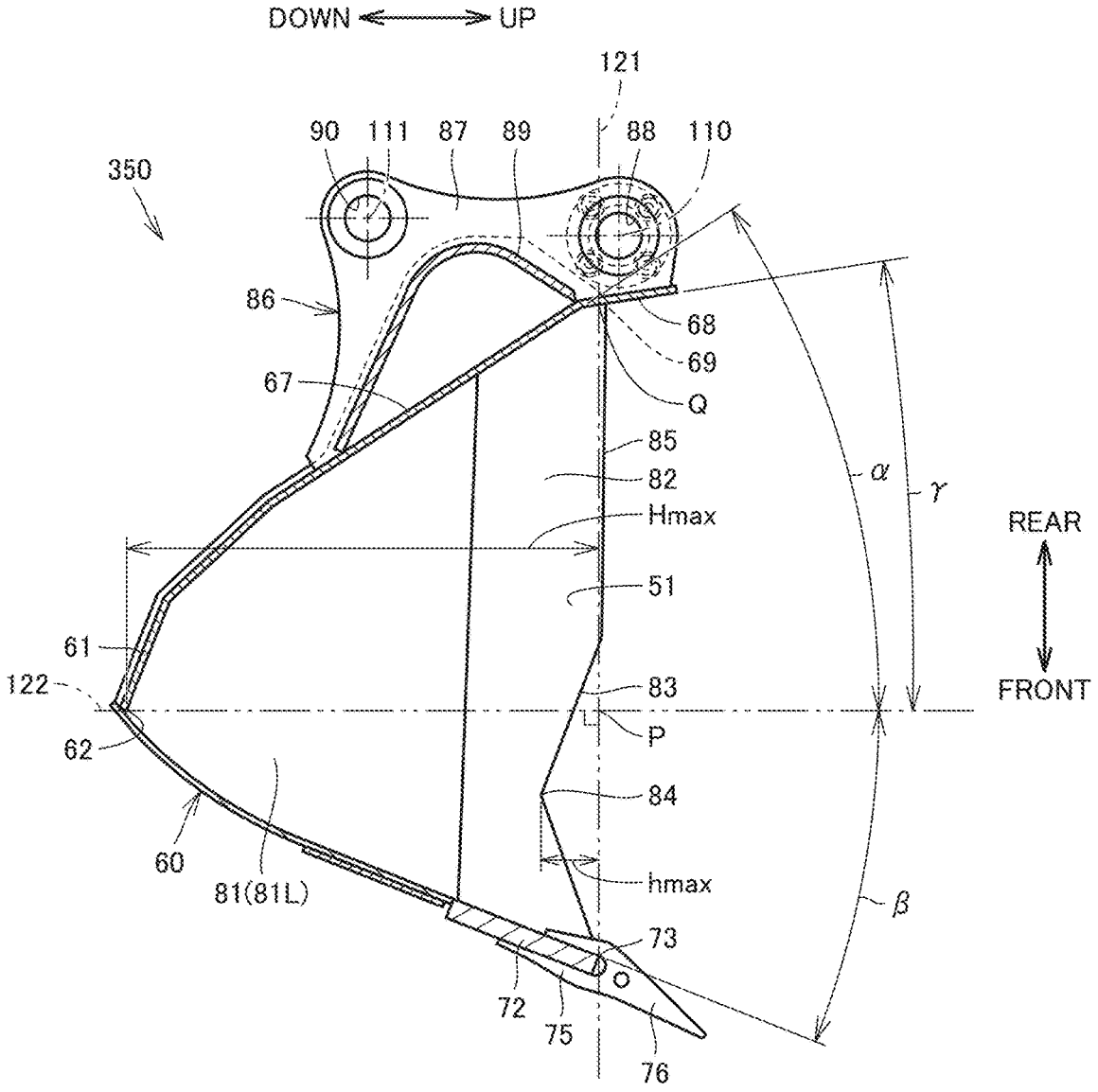
FIG. 12 is a cross-sectional view showing a bucket in the fourth embodiment of the present disclosure.

FIG. 12 is a cross-sectional view showing a bucket in the fourth embodiment of the present disclosure. FIG. 12 corresponds to FIG. 5 in the first embodiment. A bucket 350 in the present embodiment has basically the same structure as that of bucket 50 in the first embodiment. In the following, the description of the same configuration will not be repeated.

As shown in FIG. 12, bucket 350 includes a bottom plate 60, a pair of side plates 81, a bracket 86, and a front lip 72.

Front lip 72 includes a front end portion 73. Bottom plate 60 includes a rear end portion 69. Side plates 81 each include a side end portion 85. Side end portion 85 is provided with a recessed portion 83. Bottom plate 60 includes a first deepest portion 62 at which a length from first reference straight line 121 to bottom plate 60 is maximum. First reference straight line 121 passes through front end portion 73 and a position Q at which rear end portion 69 is contiguous to side plate 81. First deepest portion 62 is located on a second reference straight line 122 orthogonal to first reference straight line 121

Bottom portion 61 of bottom plate 60 has a curved shape on the front side with respect to second reference straight line 122. Bottom portion 61 has a bent shape formed by connection of two straight lines at different inclinations on the rear side with respect to second reference straight line 122. First deepest portion 62 of bottom plate 60 forms a corner portion protruding downward.

Recessed portion 83 includes a second deepest portion 84 at which a length from first reference straight line 121 to recessed portion 83 is maximum. Second deepest portion 84 is located on second reference straight line 122 or located close to front lip 72 with respect to second reference straight line 122 in the linear direction along first reference straight line 121. Second deepest portion 84 is located close to front lip 72 with respect to second reference straight line 122 in the linear direction along first reference straight line 121.

Second deepest portion 84 has a triangular cutout shape. A side lip 82 is not provided with side cutter 77 in the first embodiment.

Bottom plate 60 includes a first inclined portion 67 and a second inclined portion 68. First inclined portion 67 and second inclined portion 68 are provided on the side where bracket 86 is attached. First inclined portion 67 is contiguous to bottom portion 61. First inclined portion 67 linearly extends obliquely upward in the rearward direction from the end of bottom portion 61 on the rear side. Second inclined portion 68 is contiguous to first inclined portion 67. Second inclined portion 68 is provided along an opening 51. Second inclined portion 68 is bent at first inclined portion 67 and extends to the opening edge of opening 51. Second inclined portion 68 extends linearly from first inclined portion 67 obliquely upward in the rearward direction at an inclination different from that of first inclined portion 67. In a side view, bottom plate 60 has a bent shape that is bent at the boundary between first inclined portion 67 and second inclined portion 68.

An angle $\beta$ formed between second reference straight line 122 and front lip 72 is smaller than an angle $\alpha$ formed between second reference straight line 122 and first inclined portion 67 ($\beta<\alpha$). An angle $\gamma$ formed between second reference straight line 122 and second inclined portion 68 is smaller than angle $\alpha$ formed between second reference straight line 122 and first inclined portion 67 ($\gamma<\alpha$).

According to bucket 350 in the fourth embodiment of the present disclosure configured as described above, the same effects as those in the first and second embodiments can be achieved.

It should be understood that the embodiments disclosed herein are illustrative and non-restrictive in every respect. The scope of the present invention is defined by the scope of the claims, rather than the description above, and is intended to include any modifications within the scope and meaning equivalent to the scope of the claims.

INDUSTRIAL APPLICABILITY

The present disclosure is applicable to a bucket mounted in a work vehicle.

REFERENCE SIGNS LIST

11 vehicular body, 12 work implement, 13 revolving unit, 14 cab, 14S operator's seat, 15 traveling unit, 15Cr crawler belt, 15M travel motor, 16 boom, 17 arm, 19 engine compartment, 20A, 20B boom cylinder, 21 arm cylinder, 22 bucket cylinder, 23 boom pin, 24 arm pin, 25 bucket pin, 41 center of swing, 50, 50A, 50B, 50C, 150, 150C, 250, 350 bucket, 51 opening, 52, 53 region, 60 bottom plate, 61 bottom portion, 62 first deepest portion, 67 first inclined portion, 68 second inclined portion, 69 rear end portion, 72 front lip, 73 front end portion, 75 tooth adapter, 76 tooth, 77 side cutter, 81, 81L, 81R side plate, 82 side lip, 83 recessed portion, 84 second deepest portion, 85 side end portion, 86 bracket, 87 plate, 88, 90 hole, 89 base member, 91 reinforcement member, 100 hydraulic excavator, 110, 111 center axis, 121 first reference straight line, 122 second reference straight line, 146, 147 hatched region.

The invention claimed is:

1. A bucket coupled to an arm of a work implement to be pivotable about a prescribed axis, the bucket comprising:

a bottom plate facing an opening of the bucket;

a pair of side plates disposed to face each other on both sides of the bottom plate;

a bracket provided on a back surface of the bottom plate and coupled to the arm on the prescribed axis; and a front lip provided along the opening, wherein the front lip includes a front end portion that defines an opening edge of the opening, the bottom plate includes a rear end portion that defines an opening edge of the opening on a side where the bracket is attached, each of the side plates includes a side end portion that defines an opening edge of the opening, the bottom plate further includes a first deepest portion at which a length from a first reference straight line to the bottom plate is maximum, the first reference straight line passes through the front end portion and a position at which the rear end portion is contiguous to each of the side plates, and the first deepest portion is located on a second reference straight line orthogonal to the first reference straight line, the side end portion is provided with a recessed portion that is recessed in a direction toward the bottom plate in a side view seen from a direction along the prescribed axis, and the recessed portion includes a second deepest portion at which a length from the first reference straight line to the recessed portion is maximum, and the second deepest portion is located on the second reference straight line or located close to the front lip with respect to the second reference straight line, wherein the second deepest portion is located on the second reference straight line.

2. The bucket according to claim 1, wherein the bottom plate has a curved shape having a first curvature in the first deepest portion, and the recessed portion has a curved shape having a second curvature in the second deepest portion, and the second curvature is equal to or greater than the first curvature.

3. The bucket according to claim 2, wherein the first curvature is equal to the second curvature.

4. The bucket according to claim 1, wherein the bottom plate has a curved shape having a first curvature in the first deepest portion, and the recessed portion has a curved shape having a second curvature in the second deepest portion, and the second curvature is smaller than the first curvature.

5. A work vehicle comprising:

a vehicular body; and the work implement attached to the vehicular body, wherein the work implement includes a boom pivotably coupled to the vehicular body, the arm pivotably coupled to the boom, and the bucket according to claim 1, the bucket being pivotably coupled to the arm.

* * * * *